United States Patent [19]

Linnér

[11] Patent Number: 4,819,789

[45] Date of Patent: Apr. 11, 1989

[54] DEVICE IN A TUBE FILLING MACHINERY

[75] Inventor: Hans Linnér, Kalmar, Sweden

[73] Assignee: Norden Packaging Machinery AB, Kalmar, Sweden

[21] Appl. No.: 103,708

[22] Filed: Oct. 2, 1987

[30] Foreign Application Priority Data

Oct. 6, 1986 [SE] Sweden ..... 8604235

[51] Int. Cl.[4] ..... B65G 17/46

[52] U.S. Cl. ..... 198/803.8; 198/803.9; 141/129; 294/99.1; 294/100

[58] Field of Search ..... 198/803.7–803.9; 294/99.1, 100; 53/282; 141/129, 269, 311 R, 369, 385, 313; 269/99, 100, 104, 107, 108, 217, 266, 287

[56] References Cited

U.S. PATENT DOCUMENTS

| | | | |
|---|---|---|---|
| 2,342,337 | 2/1944 | Hallead | 198/803.8 |
| 2,802,691 | 8/1957 | Barr | 294/100 |
| 3,083,813 | 4/1963 | Lusher | 198/803.7 |
| 3,199,552 | 8/1965 | Nordfors | 198/803.8 |
| 3,342,304 | 9/1967 | Greulich | 198/803.8 |
| 3,967,847 | 7/1976 | Ellis | 198/803.9 |

FOREIGN PATENT DOCUMENTS 194366 2/1965 Sweden .

*Primary Examiner*—Joseph E. Valenza
*Attorney, Agent, or Firm*—Holman & Stern

[57] ABSTRACT

A support member arrangement for tubes in a tube filling machinery, where each support member of the machine comprises a support member part attachable to the conveyor and has a tube receiving cavity arranged generally perpendicular to the transport direction and symmetrically relative said perpendicular extension. A tube breast receiving sleeve is displaceable along an internal guide surface which is supported in the cavity in the support member and arranged for expansion and contraction. The guide surface controls the sleeve for displacement in the direction of the symmetry axis. A grip portion of the sleeve at the end thereof, facing the conveyor, grips the breast portion of the tube. The contraction and the expansion, respectively, of the squeeze sleeve is controlled by curve portions of said guide surface.

6 Claims, 4 Drawing Sheets

FIG. 4
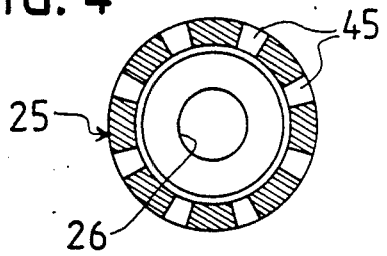
FIG. 5
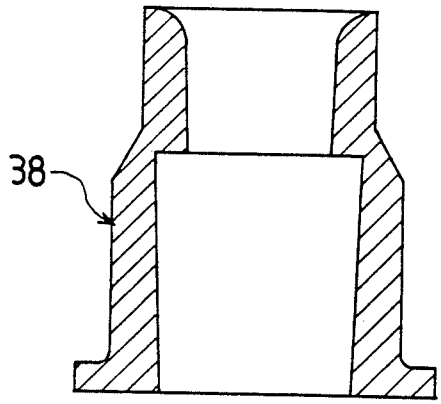
FIG. 6
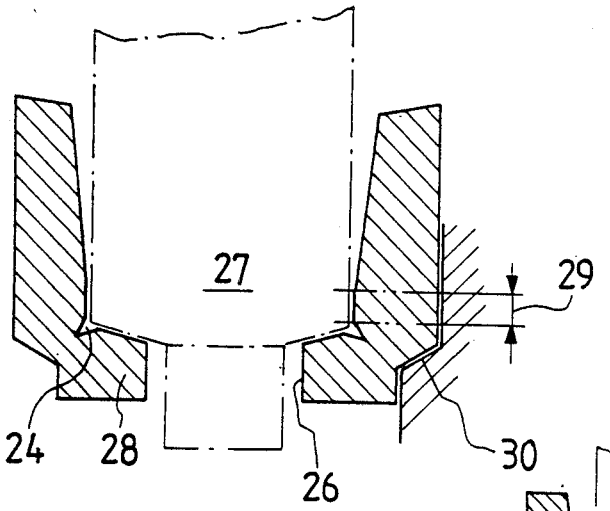
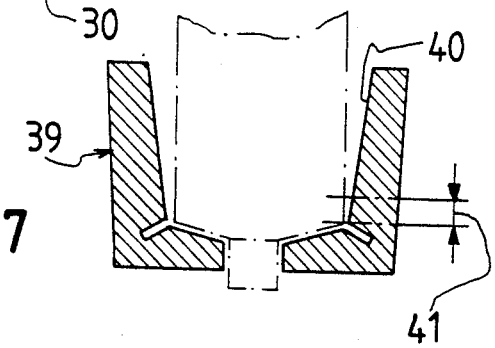
FIG. 7

DEVICE IN A TUBE FILLING MACHINERY

FIELD OF THE INVENTION

The present invention relates to a device for maintaining individual tubes fixed in support members on a conveyor in a tube filling machinery, where the conveyor forwards the support members to succeeding processing stations.

BACKGROUND OF THE INVENTION

Generally, tube filling machines operate intermittently. The resulting index movement requires a highly efficient fixation of individual tubes in their support members during the transport in the machinery. For instance the following steps may be classified as important fixation considerations:

The input—the pushing down of a tube in a support member should be easy to carry out for eliminating deformation.

After the tube has been pushed down in the support member, the tube is not allowed to slide in the support member because positioning of the tube, i.e. rotation of the tube along the longitudinal axis thereof, takes place by rotating the entire support member, generally by a step motor.

The tube is not allowed to "tilt" in the support member when indexing—if this occurs, the tube will be damaged easily—buckled, especially after filling because the tube is easily deformed due to the index motion forces.

The tube should be safely fixed in the support member when lifting, for instance for filling the tube and for hot air end sealing. If the tube is not safely fixed in the support member, it will be necessary to use specific grip claws or vacuum support in the lift head.

The support member should allow a tube shape change when flattening the tube after it has been filled at the tube cap distal end.

It should be easy to push out or lift the entire support member at the output end of the machine.

Previously, attempts have been made to satify the just mentioned list of requisites in a number of different ways.

One simple method has made use of a pipe as the support member and the upper portion of the pipe is made conical for the accommodation of the flattening of the tube by the support member as far as possible.

The next step in the development chain has been to insert squeeze jaws in the support members and push such jaws inwards by means of externally placed spiral springs.

Another approach has been to use soft support members of some type of formable rubber quality that allows sliding movement when pushing the tube outwards and inwards.

Special type of support members have also been designed and have a counter sunk lower portion for placing the gravitation center at the level of the conveyor chain in order to decrease the tilting torque at the index movement.

Internal radial rings of different types represent further alternative means used.

However, the list of requisites listed above cannot be met fully by the prior art technique known within the field.

OBJECT OF THE INVENTION

The object of the present invention is to eliminate said flue and offer a more advantageous alternative.

Basically, the inventive idea is based on the fact that the tube is strongest and has its highest form stability at the breast and the fact that, at such a tube portion, the flattening of the filling end of the tube carried out after the filling of the tube does not influence the tube.

SUMMARY OF THE INVENTION

The present invention provides a device for maintaining individual tubes fixed in support members on a conveyor in a tube filling machinery, where the conveyor forwards the support members between several processing stations along the conveyor, and where each support member comprises a support member part attachable to the conveyor and having a generally symmetric, tube receiving cavity oriented in a direction generally perpendicular to the conveyor.

The device is characterized by a tube breast receiving sleeve, which is arranged displaceable and which is arranged for radial expansion and contraction in at least certain portions thereof and is supported in the cavity of the support member, that the cavity has an internal guide surface for guiding the displacement of the sleeve in the direction of said symmetry axis, that the sleeve has a gripping portion at the end thereof facing the conveyor and directed inwards the symmetry axis of the cavity and arranged for gripping said breast portion at said contraction and for releasing the tube at expansion, and that the guide surface has curve portions, which control said contraction and expansion.

Basically, the sleeve is manufactured from a material having such a mechanic memory and of such a structure that it returns to a nominal dimension adapted for a predetermined cavity size.

In order to facilitate said contraction and expansion, the sleeve has slots extending in the direction of the symmetry axis and the slots are open at the end of the sleeve facing away from the conveyor, and a weakening denotation, preferrably a circumferential one, is arranged at said second end.

In one embodiment the guide surface design is such that it has a generally cylindrical portion, which has a conical transition portion in the region thereof which is proximal to the conveyor.

In another embodiment the guide surface is conical along the entire extension in the direction of the symmetry axis.

In order to return the squeeze sleeve to a tube receiving position a pushing out rod is arranged in the output station of the tube filling machine, and the rod has means for abutting the tube head and means for abutting the squeeze sleeve in order to positively return said sleeve to a tube receiving position, where the distal end of the squeeze sleeve assumes a collared out position.

BRIEF DESCRIPTION OF THE DRAWINGS

FIG. 4 is a cross section of the squeeze sleeve according to a first embodiment of the invention, FIG. 5 is a longitudinal section through an inner tube support member according to a second embodiment of the invention, FIG. 6 in a side view shows the squeeze sleeve according to FIG. 2 together with a tube, and FIG. 7 shows a squeeze sleeve intended for the tube support member in FIG. 5.

DESCRIPTION OF A PREFERRED EMBODIMENT

Figure 1:
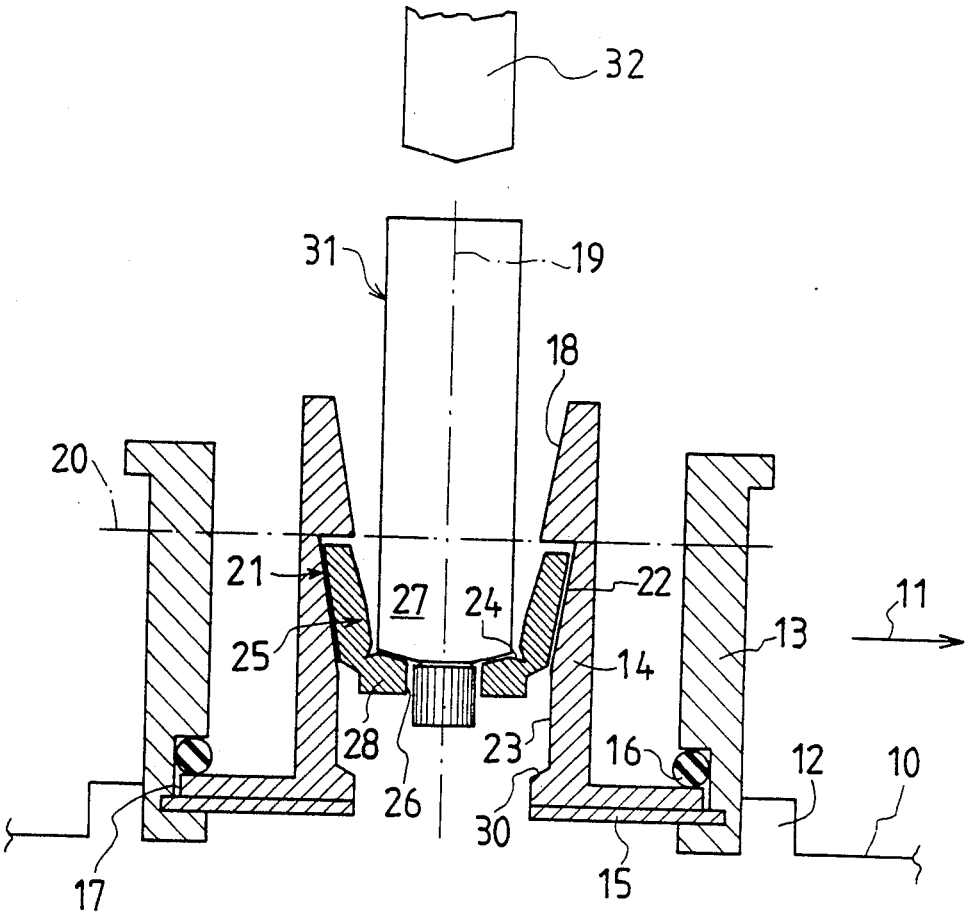
FIG. 1 is a section view along the conveyor and shows a device according to the invention in a tube input station of a tube filler, just after a tube has been guided down into a support member.

By the reference numeral 10 in FIG. 1 there is schematically shown a portion of an endless, horizontal conveyor which in the present case is intermittently displaceable in the direction of the arrow 11. In support members 12 on said conveyor there are supported outer tube support members 13. The support members 12 are designed such that a vertical displacement of the tube support members 13 is possible by means of suitable lifting devices (not shown), for instance at the processing station, where the tube should be rotated around the longitudinal axis thereof for orienting the print thereof before the bottom sealing takes place by flattening the tube at the bottom thereof.

However, lifting devices may be arranged in other stations, for instance the sealing station.

In each one of the outer tube support members 13 there is carried an inner support member 14 on a support washer 15. This washer is pressed against the lower end edge of a circumferential recess 17 in the vertically movable outer tube support member 13 by a lock ring 16.

The inner tube support member 14 has a throughgoing cavity 18 in a direction towards the conveyor and the cavity is symmetric around a centre line 19 and has an increasing opening area from a level 20 in a direction upwards from the conveyor.

Generally, such design coincides with the shape of the conventional sleeves previously used for accommodating the shape alteration of the tube after end sealing.

From a level 20 in a direction downwards towards the conveyor, however, there is a circumferential guide surface 21, which has an upper generally upwardly conical portion 22 and a generally straight, cylindrical portion 23 that follows directly after the first portion. In the embodiment that has been shown, the guide surface is terminated by a short second conical portion 30 acting as a final fixing portion.

The guide surface 21 controls a squeeze sleeve 25 for upwards and downwards movement in the inner tube support member 14. Generally, the sleeve 25 is manufactured from a material having such a mechanical memory and such a structure that it positively returns to a nominal dimension adapted for a predetermined size of a cavity 18 after contraction and expansion. The sleeve is for instance manufactured of a thermoplastics material.

In FIG. 4 there is shown an embodiment of a sleeve in section crosswise the symmetry axis.

A circumferential weakening denotation 24 at the proximal end of the sleeve and slots 45 open up at the distal end of the sleeve relative the opening 26 and facilitate the required contraction and expansion, respectively, during the movement along the guide surface.

The opening 26 is formed in a support part 28, which encompasses the tube cap and supports the tube. In that case where the tube has a so called stand cap, the support portion is arranged such that it grips the lower side of the cap.

FIG. 6 discloses the function of the conical final fixing portion. The surface 30 is arranged such that the contraction of the sleeve is concentrated to the region 29, i.e. a region where the breast portion of the tube will be located when the tube is pressed down to the bottom of the tube support member 14.

Figure 2:
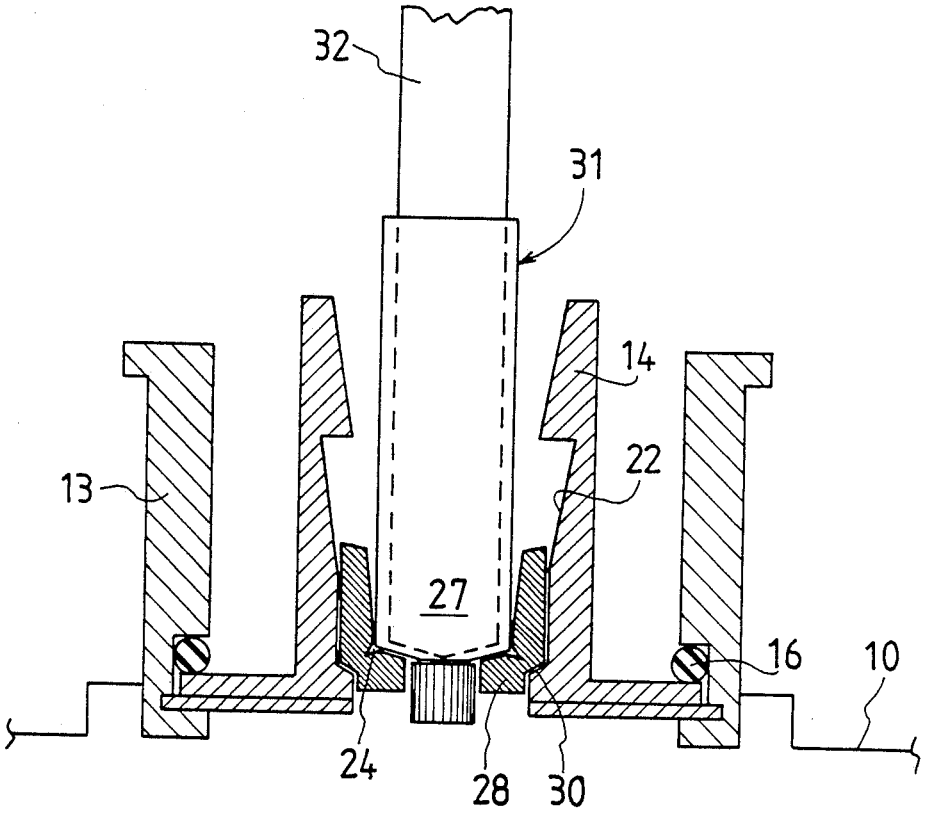
FIG. 2 shows a tube in the input station of FIG. 1 in a fixed end position.

In FIG. 2 a push down rod 32 has pushed down the tube 31 to the final fixation position, where the proximal end of the squeeze sleeve is guided downwards along the surface 30 such a distance that in the region 29 thereof the squeeze sleeve grips around the breast portion 27 of the tube with an increased force. The final phase of the positioning carried out by means of the rod comprises a movement of just a few millimeters in the vertical direction, meaning that the sleeve clamping force appears just during the end phase and, additionally, acts against the stable breast region. The procedure also allows accommodation, without deformation, of the tube within a relatively spacious tolerance region. The need for frequent replacement of support members is thereby eliminated.

The positioning of the squeeze sleeve shown in FIG. 2 and 6 means that the tube is carried in the support member in a completely stable and requisite acceptable manner during the index motion of the tube to the succeeding stations.

Such stations are the conventional ones in tube filling machineries and do not need any more detailed description.

Figure 3:
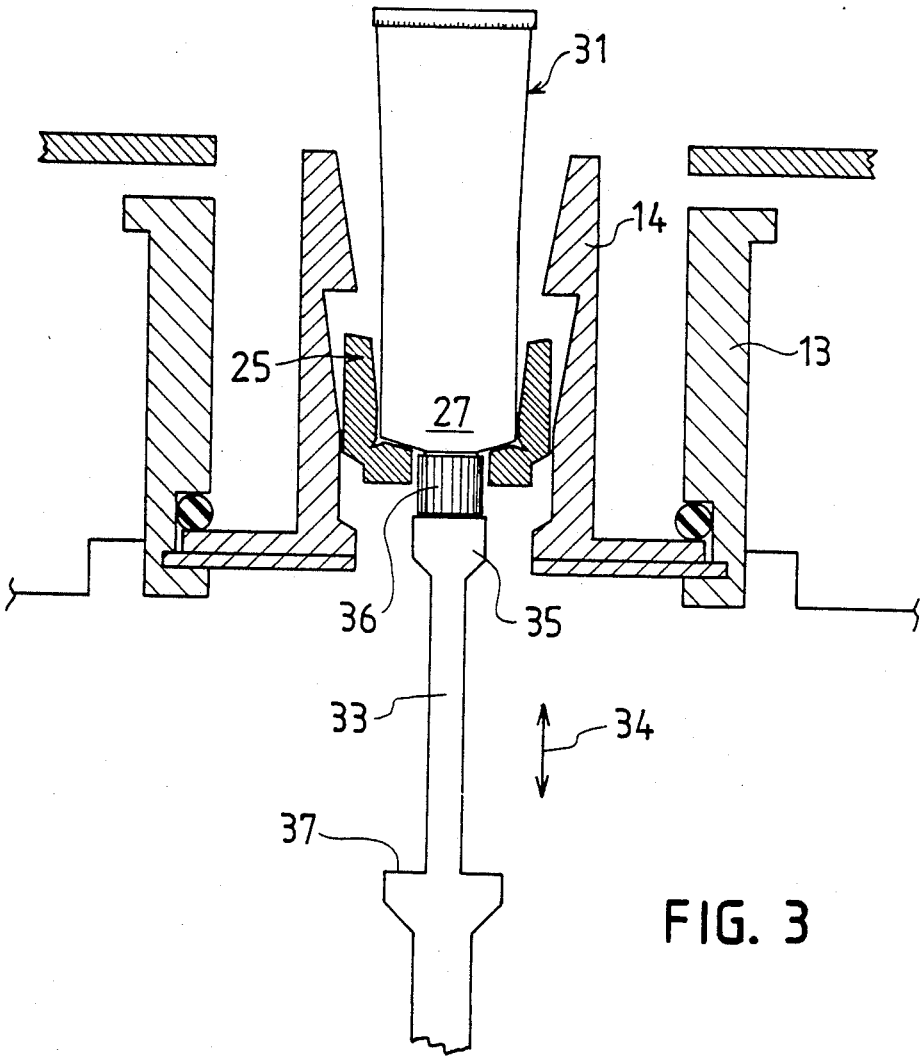
FIG. 3 shows the tube in the output station of the machine.

In FIG. 3 there is shown the end station, i.e. the pusher out station. A pusher out rod 33 is arranged for upwards and downwards movement in the direction of the double arrow 34. This rod has a head 35 intended to be pressed against the cap 36 of the tube and a squeeze sleeve lifting ledge 37. This one guarantees that the squeeze sleeve, when it again arrives into the input station in FIG. 1, assumes its collared out position with a placement at the top of the guide surface 21.

The tube support member 38 in FIG. 5 and the squeeze sleeve 39 in FIG. 7 represent examples of designs where the "concentration" of squeezing forces to the breast portion of the tube is accomplished by simplified means.

The guide surface simply represents a conical surface, which is such that the squeeze sleeve is given a contraction during the movement thereof to the end position. The conicity is such relative the dimensioning of the squeeze sleeve that the fixation force is concentrated to the region 41 during the ultimate phase of the tube insertion process.

We claim:

1. A device for maintaining individual tubes in fixed positions in support members on a conveyor in a tube filling machinery, where the conveyor forwards the support members between successive processing stations along the conveyor, and where each support member comprises a support member part attachable to the conveyor and having a tube receiving cavity extending generally perpendicular to the conveyor and generally symmetric around an axis in said perpendicular direction, comprising:

a displaceable tube breast receiving sleeve supported in the cavity of the support member and displaceable therein along said symmetry axis thereof, said sleeve being arranged for radial expansion and contraction in at least certain portions thereof, the sleeve being formed of a material having a mechanical memory whereby the sleeve positively returns to a nominal dimension for a predetermined cavity size after undergoing said expansion and contraction;

an internal guide surface provided in the cavity of the support member for controlling the displacement of the sleeve in the direction of said symmetry axis, said internal guide surface including a generally conical portion opening outwardly along said symmetry axis and engaged by said sleeve for controlling the radial expansion and contraction of said sleeve, said internal guide surface being terminated by end stops at respective axial ends thereof for limiting displacement of said sleeve along said symmetry axis; and a grip portion extending inwardly towards the symmetry axis arranged at an end of the sleeve facing the conveyor for gripping a breast portion of a tube under contraction of said sleeve and releasing the tube under expansion of said sleeve.

2. A device as in claim 1, wherein the sleeve has first slots extending in the direction of the symmetry axis and opening up at the end of the sleeve facing away from the conveyor, and a weakening is arranged at the other end thereof.

3. A device as in claim 2, wherein the internal guide surface further includes a generally cylindrical guide surface portion in a region thereof proximal to the conveyor.

4. A device as in claim 3, wherein the cylindrical guide surface portion has a transition portion forming a final fixation portion with a narrowing configuration towards the conveyor, and wherein the said grip portion is brought into engagement with the tube breast.

5. A device as in claim 4, wherein the final fixation portion is generally conically narrowing and has a height in the direction of the symmetry axis of a few millimeters.

6. A device as in claim 2, wherein the guide surface is generally conical the whole way up to the open end of the conveyor.

* * * * *